US006408754B2

(12) United States Patent
Siler et al.

(10) Patent No.: US 6,408,754 B2
(45) **Date of Patent: *Jun. 25, 2002**

(54) FLEXOGRAPHIC PRINTING APPARATUS

(76) Inventors: Steven J. Siler, 363 Margaret Terr., Cary, IL (US) 60013; David M. Klein, 464 Forest Dr., Fontana, WI (US) 53125

( * ) Notice: Subject to any disclaimer, the term of this patent is extended or adjusted under 35 U.S.C. 154(b) by 0 days.

This patent is subject to a terminal disclaimer.

(21) Appl. No.: 09/816,059

(22) Filed: Mar. 23, 2001

Related U.S. Application Data

(63) Continuation of application No. 09/310,259, filed on May 12, 1999, now Pat. No. 6,314,879.

(51) Int. Cl.[7] ..... B41N 6/00; B41F 9/00; B41M 1/10

(52) U.S. Cl. ..... 101/401.1; 101/153; 101/170; 101/489; 101/DIG. 37

(58) Field of Search ..... 101/401.1, 465, 101/219, 395, 170, 389, 153, DIG. 37, 450.1; 118/621; 430/49; 346/74.2; 347/111, 112; 399/174–176, 166, 313

(56) References Cited

U.S. PATENT DOCUMENTS

| | | | | | |
|---|---|---|---|---|---|
| 3,370,546 | A | | 2/1968 | Muller | 101/91 |
| 3,477,369 | A | | 11/1969 | Adamson et al. | 101/153 |
| 3,554,123 | A | | 1/1971 | Lewallen | 101/170 |
| 3,619,720 | A | | 11/1971 | Coberley | 317/3 |
| 3,625,146 | A | | 12/1971 | Hutchison | 101/153 |
| 3,661,081 | A | | 5/1972 | Wright | 101/426 |
| 4,099,462 | A | | 7/1978 | Coberley et al. | 101/153 |
| 4,208,965 | A | | 6/1980 | Eichler et al. | 101/426 |
| 4,360,850 | A | | 11/1982 | Howard et al. | 361/56 |
| 4,440,082 | A | * | 4/1984 | Carey et al. | 101/170 |
| 4,539,908 | A | | 9/1985 | Spengler | 101/426 |
| 4,697,514 | A | | 10/1987 | George et al. | 101/170 |
| 4,909,147 | A | | 3/1990 | George et al. | 101/170 |
| 4,966,555 | A | | 10/1990 | Zagorski | 439/28 |
| 5,044,275 | A | * | 9/1991 | Knopf et al. | 101/153 |
| 5,178,071 | A | | 1/1993 | Hylberg | 101/489 |
| 5,213,042 | A | * | 5/1993 | Larios | 101/450.1 |
| 5,243,487 | A | | 9/1993 | Klett | 361/56 |
| 5,399,248 | A | | 3/1995 | Ettelbruck et al. | 204/212 |
| 5,768,990 | A | | 6/1998 | Vrotacoe et al. | 101/217 |
| 5,797,322 | A | | 8/1998 | Lorig et al. | 101/375 |
| 5,829,355 | A | * | 11/1998 | Spengler | 101/489 |
| 5,983,799 | A | | 11/1999 | Lane, III et al. | 101/375 |
| 6,000,333 | A | | 12/1999 | Davis | 101/132 |
| 6,314,879 | B1 | * | 11/2001 | Siler et al. | 101/153 |

FOREIGN PATENT DOCUMENTS

| | | |
|---|---|---|
| EP | 0761458 | 3/1997 |
| WO | 9803049 | 1/1998 |

* cited by examiner

*Primary Examiner*—Eugene Eickholt
(74) *Attorney, Agent, or Firm*—Marshall, Gerstein & Borun

(57) ABSTRACT

A flexographic printing apparatus for printing a moving web is provided with a rotatable ink roller, a roller support that rotatably supports the ink roller, an ink source associated with the ink roller which provides ink for the ink roller, a rotatable printing roller associated with the ink roller, and a printing plate disposed on the printing roller that makes physical contact with the ink roller so that ink is transferred from the ink roller to the printing plate as the ink roller and the printing roller rotate. The printing apparatus also has a rotatable backing roller disposed adjacent the printing roller so that the moving web on which ink is to be applied passes between the backing roller and the printing plate as the backing roller and the printing roller rotate so that a printed image is applied to the web. The apparatus also has a charge applicator that causes an electric charge to be applied to the semi-conductive printing plate.

4 Claims, 2 Drawing Sheets

FLEXOGRAPHIC PRINTING APPARATUS

This is a continuation of U.S. Ser. No. 09/310,259, now U.S. Pat. No. 6,314,879 filed in the U.S. Patent Office on May 12, 1999, which is incorporated herein by reference in its entirety.

BACKGROUND OF THE INVENTION

The present invention is directed to a flexographic printing apparatus, and more particularly to a flexographic printing apparatus having an electric charging unit to enhance print quality.

A conventional flexographic printing press is typically provided with a plurality of printing stations, each of which prints a moving web with an image in a respective color. Each of the printing stations is provided with a rotating cylindrical ink roller, also referred to as an "anilox" roller, having a regular pattern of minute recesses or ink cells formed therein. Ink is applied to the ink roller by submerging at least a portion of the ink roller in an ink reservoir, or by applying ink to a portion of the ink roller via an ink applicator.

A flexographic press has a rotating cylindrical printing roller disposed adjacent the ink roller. The printing roller has a printing plate mounted thereon. The printing plate may be held in place on the printing roller by an adhesive layer, such as adhesive tape, disposed between the printing plate and the printing roller. The printing plate is composed of a photo-sensitive material that is subjected to a photo-etching process to form raised portions on the printing plate which correspond to a desired image to be printed. The printing roller is disposed adjacent the ink roller so that ink is transferred from the ink cells in the ink roller to the raised areas on the printing plate.

U.S. Pat. No. 4,697,514 to George, et al. discloses a gravure printing apparatus having a gravure cylinder that is disposed partially within an ink reservoir, a backing roller disposed adjacent the gravure cylinder, and an apparatus for applying a voltage to the backing roller. As shown in FIG. 7 of the George, et al. patent and described in connection therewith, the application of the voltage to the backing roller causes ink within the ink cells to rise above the surface of the gravure cylinder in order to enhance the ink transfer from the gravure cylinder to a paper web being printed.

SUMMARY OF THE INVENTION

In one aspect, the invention is directed to a flexographic printing apparatus for printing a moving web. The printing apparatus has a rotatable ink roller, a roller support that rotatably supports the ink roller, an ink source associated with the ink roller which provides ink for the ink roller, a rotatable printing roller associated with the ink roller, and a printing plate disposed on the printing roller that makes physical contact with the ink roller so that ink is transferred from the ink roller to the printing plate as the ink roller and the printing roller rotate.

The printing apparatus also has a rotatable backing roller disposed adjacent the printing roller so that the moving web on which ink is to be applied passes between the backing roller and the printing plate as the backing roller and the printing roller rotate so that a printed image is applied to the web. The apparatus also has a charge applicator that causes an electric charge to be applied to the printing plate.

The printing plate may be composed of a semi-conductive printing layer having an image-forming surface. The semi-conductive printing layer may have a resistivity in the range between about 50 thousand ohms per cubic centimeter and about 1.5 megohms per cubic centimeter. The printing layer may be a photo-sensitive polymer doped with conductive particles, and may have a resistivity in the range between about 100 thousand ohms per cubic centimeter and about one megohm per cubic centimeter. The charge applicator may be provided in the form of an elongate charge bar having a plurality of charging electrodes spaced from the printing roller. Alternatively, the charge applicator may make direct physical contact with a portion of the printing plate or the roller on which the printing plate is supported.

The printing apparatus may also have an insulating layer disposed between a semi-conductive printing layer and the printing roller. The insulating layer may have a resistivity of greater than about two megohms per cubic centimeter. The insulating layer may be provided in the form of an adhesive layer disposed between the printing layer and the printing roller.

The printing apparatus may also have a conductive layer disposed adjacent the semi-conductive printing layer, the conductive layer having a resistivity lower than about 50 thousand ohms per cubic centimeter, and a high voltage may be applied directly to the conductive layer in order to impart an electric charge to the semi-conductive printing layer.

The invention is also directed to a printing structure for a flexographic printing apparatus having a rotatable ink roller, a roller support that rotatably supports the ink roller, an ink source associated with the ink roller which provides ink to be applied to the ink roller, a rotatable printing roller associated with the ink roller, and a rotatable backing roller disposed adjacent the printing roller.

The printing structure has a semi-conductive printing layer adapted to be disposed on a printing roller. The semi-conductive printing layer is composed of a photo-sensitive polymer material having a resistivity in the range between about 50 thousand ohms per cubic centimeter and about 1.5 megohms per cubic centimeter. The semi-conductive printing layer has an image-forming surface having a plurality of raised areas corresponding to an image to be printed.

The semi-conductive printing layer may have a thickness of less than about one-fourth of an inch, and the semi-conductive printing layer may have a resistivity in the range between about 100 thousand ohms per cubic centimeter and about one megohm per cubic centimeter. The resistivity of the semi-conductive printing layer may be due to the presence of conductive particles therein. The printing structure may have an insulating layer disposed adjacent the semi-conductive printing layer, with the insulating layer having a resistivity of greater than about 100 megohms per cubic centimeter. The printing structure may also have a conductive layer disposed adjacent the semi-conductive printing layer, with the conductive layer having a resistivity lower than about 50 thousand ohms per cubic centimeter.

In a second aspect, the invention is directed to a flexographic printing apparatus for printing a moving web that comprises a rotatable ink roller, a roller support that rotatably supports the ink roller, an ink source associated with the ink roller that provides ink to be applied to the ink roller, a rotatable printing roller associated with the ink roller, and a printing plate disposed on the printing roller that makes physical contact with the ink roller so that ink is transferred from the ink roller to the printing plate as the ink roller and the printing roller rotate. The printing plate comprises a semi-conductive printing layer having an image-forming surface and a resistivity in the range between about 50 thousand ohms per cubic centimeter and about 1.5 megohms per cubic centimeter and an insulating layer disposed between the semi-conductive layer and the printing roller, the insulating layer having a resistivity of greater than about two megohms per cubic centimeter. The apparatus also includes a rotatable backing roller disposed adjacent the printing roller so that the moving web on which ink is to be applied passes between the backing roller and the printing plate as the backing roller and the printing roller rotate so that a printed image is applied to the web and a charge applicator associated with the printing roller that causes an electric charge to be applied to the semi-conductive printing plate.

In the invention in accordance with the second aspect, the charge applicator may comprise an elongate charge bar having a plurality of charging electrodes spaced from the printing roller; the charge applicator may make physical contact with a portion of the printing plate; the insulating layer of the printing plate may comprise an insulating sleeve; the insulating layer of the printing plate may comprise a fiberglass sleeve; the semi-conductive printing layer may comprises a photo-sensitive polymer doped with conductive particles; and the semi-conductive printing layer may have a resistivity in the range between about 100 thousand ohms per cubic centimeter and about one megohm per cubic centimeter.

In a third aspect, the invention is directed to a flexographic printing apparatus for printing a moving web that comprises a rotatable ink roller, a roller support that rotatably supports the ink roller, an ink source associated with the ink roller that provides ink to be applied to the ink roller, a rotatable printing roller associated with the ink roller, a printing plate disposed on the printing roller, the printing plate having an image-forming surface and making physical contact with the ink roller so that ink is transferred from the ink roller to the printing plate as the ink roller and the printing roller rotate, a rotatable backing roller disposed adjacent the printing roller so that the moving web on which ink is to be applied passes between the backing roller and the printing plate as the backing roller and the printing roller rotate so that a printed image is applied to the web, and a charge applicator associated with the printing roller that causes an electric charge to be applied to the printing plate.

In the invention in accordance with the third aspect, the printing plate may comprise a photo-sensitive polymer doped with conductive particles; the charge applicator may comprise an elongate charge bar having a plurality of charging electrodes spaced from the printing roller; the charge applicator may make physical contact with a portion of the printing plate; and the adhesive layer may be disposed between the printing plate and the printing roller.

In a fourth aspect, the invention is directed to a flexographic printing apparatus for printing a moving web comprising a rotatable ink roller, a roller support that rotatably supports the ink roller, an ink source associated with the ink roller and providing ink to be applied to the ink roller, a rotatable printing roller associated with the ink roller, and a printing structure disposed on the printing roller that makes physical contact with the ink roller so that ink is transferred from the ink roller to the printing structure as the ink roller and the printing roller rotate. The printing structure comprises a semi-conductive printing layer having an image-forming surface and a resistivity in the range between about 50 thousand ohms per cubic centimeter and about 1.5 megohms per cubic centimeter, a conductive layer disposed adjacent the semi-conductive printing layer and having a resistivity lower than about 50 thousand ohms per cubic centimeter, and an insulating layer disposed between the conductive layer and the printing roller, the insulating layer having a resistivity of greater than about two megohms per cubic centimeter. The apparatus also includes a rotatable backing roller disposed adjacent the printing roller so that the moving web on which ink is to be applied passes between the backing roller and the printing structure as the backing roller and the printing roller rotate so that a printed image is applied to the web and a charge applicator associated with the printing roller that causes an electric charge to be applied to the semi-conductive printing layer.

In the invention in accordance with the fourth aspect, the semi-conductive printing layer may have a resistivity in the range between about 100 thousand ohms per cubic centimeter and about one megohm per cubic centimeter, and the charge applicator may make physical contact with a portion of the conductive layer of the printing structure.

In a fifth aspect, the invention is directed to a printing structure for a flexographic printing apparatus having a rotatable ink roller, a roller support that rotatably supports the ink roller, an ink source associated with the ink roller which provides ink to be applied to the ink roller, a rotatable printing roller associated with the ink roller, and a rotatable backing roller disposed adjacent the printing roller. The printing structure comprises a semi-conductive printing layer adapted to be disposed on a printing roller, the semi-conductive printing layer comprising a photo-sensitive polymer material having a resistivity in the range between about 50 thousand ohms per cubic centimeter and about 1.5 megohms per cubic centimeter, and an image-forming surface on the photo-sensitive polymer material that has a plurality of raised areas corresponding to an image to be printed.

In the invention in accordance with the fifth aspect, the semi-conductive printing layer may have a thickness of less than about one-fourth of an inch, and the semi-conductive printing layer may have a resistivity in the range between about 100 thousand ohms per cubic centimeter and about one megohm per cubic centimeter.

In a sixth aspect, the invention is directed to a printing structure for a flexographic printing apparatus having a rotatable ink roller, a roller support that rotatably supports the ink roller, an ink source associated with the ink roller which provides ink to be applied to the ink roller, a rotatable printing roller associated with the ink roller, and a rotatable backing roller disposed adjacent the printing roller. The printing structure comprises a semi-conductive printing layer adapted to be disposed on a printing roller. The semi-conductive printing layer comprises a photo-sensitive polymer material having a resistivity in the range between about 50 thousand ohms per cubic centimeter and about 1.5 megohms per cubic centimeter and an image-forming surface on the photo-sensitive polymer material that has a plurality of raised areas corresponding to an image to be printed. The printing structure also comprises an insulating layer disposed adjacent the semi-conductive printing layer that has a resistivity of greater than about two megohms per cubic centimeter.

In the invention in accordance with the sixth aspect, the photo-sensitive polymer material may have a concentration of conductive particles dispersed therein to provide the semi-conductive printing layer with a resistivity in the range between about 50 thousand ohms per cubic centimeter and about 1.5 megohms per cubic centimeter; the insulating layer may comprise an insulating sleeve; the insulating layer may comprise a fiberglass sleeve; the printing structure may have a thickness of less than about one-fourth of an inch; and the semi-conductive printing layer may have a resistivity in the range between about 100 thousand ohms per cubic centimeter and about one megohm per cubic centimeter.

In a seventh aspect, the invention is directed to a printing structure for a flexographic printing apparatus having a rotatable ink roller, a roller support that rotatably supports the ink roller, an ink source associated with the ink roller which provides ink to be applied to the ink roller, a rotatable printing roller associated with the ink roller, and a rotatable backing roller disposed adjacent the printing roller. The printing structure comprises a semi-conductive printing layer adapted to be disposed on a printing roller. The semi-conductive printing layer comprises a photo-sensitive polymer material having a resistivity in the range between about 50 thousand ohms per cubic centimeter and about 1.5 megohms per cubic centimeter and an image-forming surface on the photo-sensitive polymer material that has a plurality of raised areas corresponding to an image to be printed. The printing structure also comprises a conductive layer disposed adjacent the semi-conductive printing layer that has a resistivity lower than about 50 thousand ohms per cubic centimeter and an insulating layer disposed adjacent the conductive layer that has a resistivity of greater than about two megohms per cubic centimeter.

In the invention in accordance with the seventh aspect, the photo-sensitive polymer material may have a concentration of conductive particles dispersed therein to provide the photo-sensitive polymer material with a resistivity in the range between about 50 thousand ohms per cubic centimeter and about 1.5 megohms per cubic centimeter; the insulating layer may comprise an insulating sleeve; the insulating layer may comprise a fiberglass sleeve; the printing structure may have a thickness of less than about one-fourth of an inch; and the semi-conductive printing layer may have a resistivity in the range between about 100 thousand ohms per cubic centimeter and about one megohm per cubic centimeter.

In accordance with a further aspect, the invention is directed to a flexographic printing apparatus for printing a moving web comprising a rotatable ink roller, a roller support that rotatably supports the ink roller, an ink source associated with the ink roller that provides ink to be applied to the ink roller, a rotatable printing roller associated with the ink roller, and a printing plate disposed on the printing roller that is supported so that ink is transferred from the ink roller to the printing plate as the ink roller and the printing roller rotate. The printing plate comprises a semi-conductive printing layer having an image-forming surface and comprising a photo-sensitive polymer material and a substrate layer on which the semi-conductive printing layer is formed. The substrate layer comprises an insulating material having a resistivity of greater than about two megohms per cubic centimeter. The semi-conductive printing layer comprises a plurality of portions of semi-conductive material formed on the substrate layer that are spaced apart and formed so that portions of the substrate layer are not covered by the portions of the semi-conductive material. The apparatus also comprises an insulating layer disposed on the printing roller between an outer surface of the printing roller and the printing plate, a rotatable backing roller disposed adjacent the printing roller so that the moving web to which ink is to be applied passes between the backing roller and the printing plate as the backing roller and the printing roller rotate so that a printed image is applied to the web, and a charge applicator associated with the printing roller that causes an electric charge to be applied to the printing plate. The charge applicator comprises an elongate charge bar having a plurality of charging electrodes spaced from the printing plate, the charging electrodes being evenly spaced from each other in a direction parallel to a central axis of the printing roller, each of the charging electrodes being conductively connected to a voltage.

The features and advantages of the invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
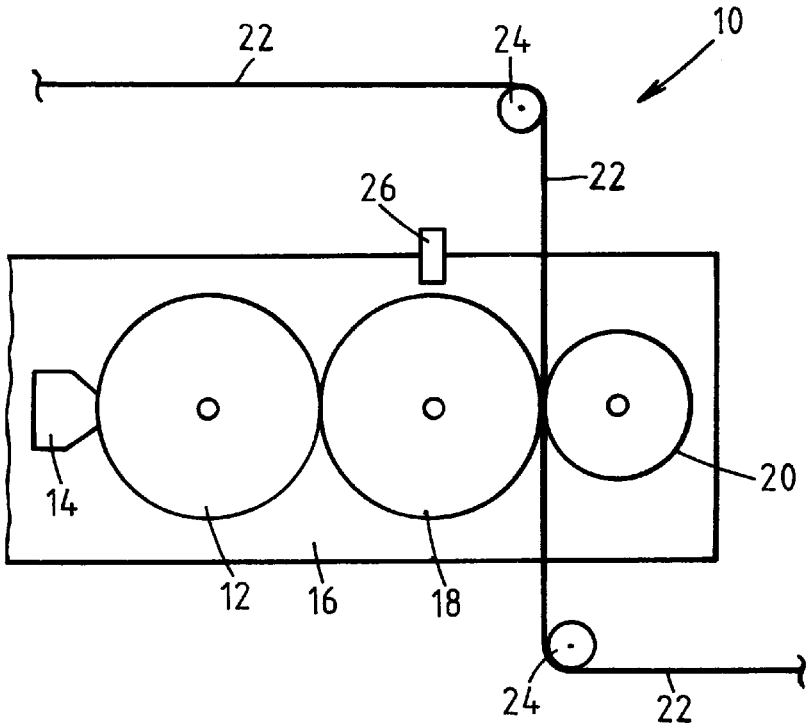
FIG. 1 is a side view of one embodiment of a flexographic printing apparatus in accordance with the invention.

FIG. 1 illustrates an embodiment of a flexographic printing apparatus 10 in accordance with the invention. Referring to FIG. 1, the printing apparatus 10 has a cylindrical ink roller 12 and an ink applicator 14 that applies ink to the ink roller 12. The ink applicator 14 may be, for example, a chambered doctor blade or other conventional ink applying device. The ink roller 12 is rotatably supported by a support frame 16 so that the ink roller 12 is in contact with a cylindrical printing roller 18. The support frame 16 rotatably supports the printing roller 18 adjacent a cylindrical backing roller 20. An elongate web 22, composed of paper for example, to which ink is to be applied passes through the nip between the printing roller 18 and the backing roller 20. The web 22 may be supported or directed by a plurality of support rollers 24. A charge bar 26 may be disposed adjacent the printing roller 18 for applying an electric charge to the printing roller 18, as described in more detail below. The printing apparatus 10 may also include a conventional dryer (not shown) for drying the ink after it is applied to the web 22 and a conventional cooling apparatus (not shown), such as that disclosed in U.S. Pat. No. 5,881,647, which is incorporated by reference herein, for cooling the web 22 after it passes through the dryer.

Figure 2:
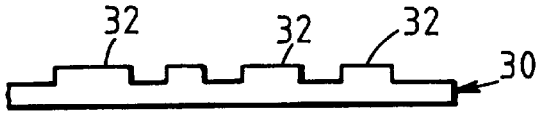
FIG. 2 is a side view of a portion of an embodiment of a printing plate used in the flexographic printing apparatus.

FIG. 2 illustrates a portion of one embodiment of a printing plate 30 (shown much larger than actual size) that is disposed on the exterior of the printing roller 18. The printing plate 30 has numerous small raised portions 32 which transfer ink from the ink roller 12 to the web 22. The raised portions 32 are non-uniform in shape and correspond to a desired image to be printed on the web 22. The raised portions 32 on the printing plate 30 may be formed via a photo-sensitive etching process in which portions of the printing plate 30 are selectively exposed to radiation, with the unexposed portions being subsequently removed via an etching agent, thus leaving the raised portions 32. The total thickness of the printing plate 30 could be approximately one-eighth to one-sixteenth of an inch, for example. Other methods of forming the raised portions 32 of the printing plate 30 could be utilized.

The printing plate 30 may be composed of a semi-conductive material having a resistivity in the range between about 50 thousand ohms per cubic centimeter and about 1.5 megohms per cubic centimeter, or in the range between about 100 thousand ohms per cubic centimeter and about one megohm per cubic centimeter. That resistivity allows the printing plate 30 to retain an electric charge as provided by the charge bar 26 or another charge-application device.

The printing plate 30 may be composed of a photo-sensitive polymer material. Photo-sensitive polymer material is commercially available in either solid or liquid form. The printing plate 30 could be made by melting photo-sensitive material in solid form and then doping the resulting liquid material, to achieve a specific resistivity or range of resistivities, by dispersing conductive particles within the liquid so that the particles are in suspension in the liquid. Any type of conductive particles, such as carbon powder, powdered metals, various salts, etc., could be used. Some types of salts would be dissolve in the liquid. As an alternative to doping the polymer material with a conductive agent, a photo-sensitive polymer material with semi-conductive properties could be utilized. The liquid polymer material may then be extruded through a die to form a sheet of material, which may then be cooled with a chilled roller to form a solid sheet.

The solid sheet may then be photographically exposed to light or radiation through a negative of the image which is to be printed. After such exposure, the sheet is washed with, or otherwise exposed to, an etching agent, so that the areas on the sheet which were photographically exposed are removed, leaving the raised portions 32.

When the printing plate 30 is made from a photo-sensitive polymer material that is in liquid form, the liquid material can be formed into a solid sheet via a mold (after suitable doping if necessary), after which the sheet is photographically etched as described above.

The fabrication methods described above result in a printing layer 30, including raised portions 32, composed entirely of semi-conductive polymer material, as shown in FIG. 2.

Figure 3:
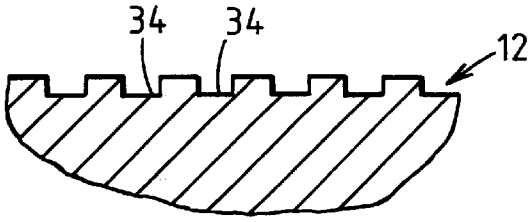
FIG. 3 is a side view of a portion of an ink roller of the flexographic printing apparatus.

FIG. 3 is a cross-sectional view of a portion of the ink roller 12. Referring to FIG. 3, the outer surface of the ink roller 12 has numerous, minute recesses or wells 34 formed therein in which ink may be deposited. The ink wells 34, which are identical in shape and spacing, pick up ink from the ink reservoir 14 for transfer to the raised portions 32 on the printing plate 30 with which the ink roller 12 makes contact.

Figure 4:
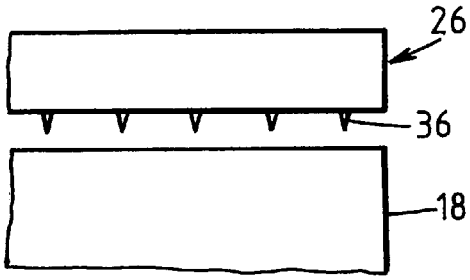
FIG. 4 illustrates a portion of a charge bar disposed adjacent a portion of a printing roller.

FIG. 4 illustrates the charge bar 26 in more detail. Referring to FIG. 4, the charge bar 26 has a plurality of pointed electrodes 36, which may be evenly spaced adjacent the entire length of the printing roller 18. The pointed electrodes 36 may be spaced from the outer surface of the printing roller 18 by about one-half of an inch, for example. The pointed electrodes 36 are conductively interconnected so that each is connected to a high (positive or negative) voltage, such as a voltage in the range of between about 10,000 and 30,000 volts. The proximity of that high voltage causes an electric charge to be induced in the semi-conductive printing plate 30, which enhances the transfer of ink from the raised portions 32 of the printing plate 30 to the web 22. A specific example of a charge bar that could be utilized is disclosed in U.S. Pat. No. 5,881,647 entitled "Printing Press With Electrostatic Cooling," which is incorporated by reference herein.

During operation of the printing apparatus 10, the rotation of the ink roller 12 causes the ink cells 34 to be periodically filled with ink. The ink in the ink cells 34 in the ink roller 12 is transferred to the raised portions 32 of the printing plate 30 on the printing roller 18 at the point at which the two rollers 12, 18 make physical contact. The ink is then transferred from the raised portions 32 to the web 22 at the nip between the printing roller 18 and the backing roller 20.

Figure 6:
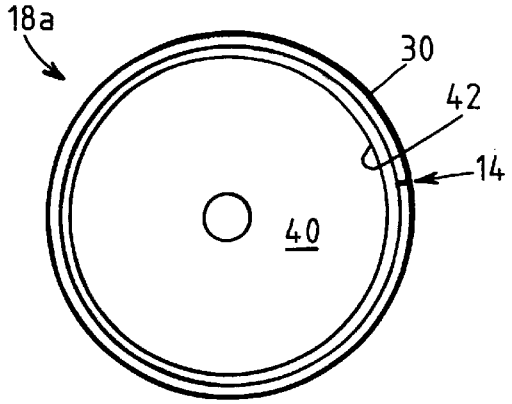
FIG. 6 illustrates a first embodiment of a printing roller usable with the flexographic printing apparatus of FIG. 1.

FIG. 6 illustrates one embodiment of a printing roller 18*a* that may be utilized in the printing apparatus 10. The printing roller 18*a* has a central core 40, which may be composed of metal, over which the printing plate 30 is disposed via an adhesive layer 42, such as a layer of double-backed adhesive tape. The ends of the printing plate 30 may be disposed adjacent each other at a seam 44. The adhesive layer 42 acts as an insulating layer to prevent significant amounts of electric charge from passing from the printing plate 30 to the central core 40. Alternatively, the printing plate 30 may be held in place on the printing roller 18 magnetically.

Figure 7:
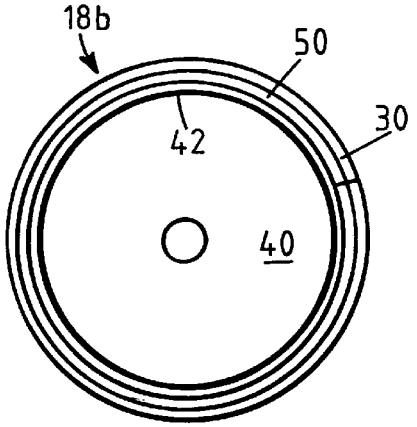
FIG. 7 illustrates a second embodiment of a printing roller usable with the flexographic printing apparatus of FIG. 1.

FIG. 7 illustrates a second embodiment of a printing roller 18*b* that may be utilized in the printing apparatus 10. The printing roller 18*b* is generally the same as the printing roller 18*a* described above in connection with FIG. 6, except that an extra insulating layer 50 is disposed between the adhesive layer 42 and the printing plate 30. The insulating layer 50 may be used to ensure that there is no significant leakage of electric charge from the semi-conductive printing plate 30 to the central core 40. Such charge leakage could occur, for example, where the adhesive layer 42 is in the form of adhesive tape and where the adhesive tape does not completely cover the central core 40. The insulating layer 50 may have a resistivity greater than about two megohms per cubic centimeter. The thickness of the insulating layer 50 could be approximately one-sixteenth of an inch.

The insulating layer 50 could be glued or otherwise bonded to the printing plate 30. For example, the printing plate 30 and the insulating layer 50 could be formed via a double-extrusion process in which both layers are simultaneously extruded, each layer being extruded from a separate liquid or semi-solid, to form a respective layer, with the two layers being disposed in contact with each other to bond them together prior to their complete solidification. After the two layers 30, 50 are bonded together, the desired printing pattern would be imparted to the printing plate 30, such as by a conventional photo-sensitive etching process.

Figure 8:
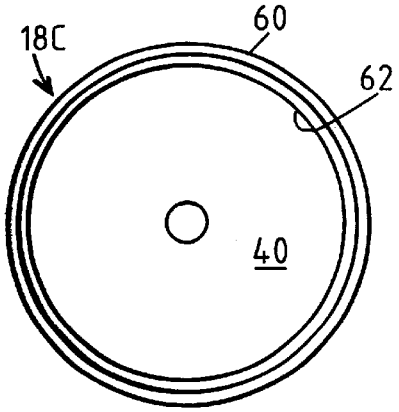
FIG. 8 illustrates a third embodiment of a printing roller usable with the flexographic printing apparatus of FIG. 1.

FIG. 8 illustrates a third embodiment of a printing roller 18*c* that may be utilized in the printing apparatus 10. The printing roller 18*c* is provided with a seamless semi-conductive printing plate 60 (which may have any of the resistivity ranges noted herein and which may be composed of a photo-sensitive polymer material), which is disposed on the exterior of a seamless insulating sleeve 62, which may be composed of fiberglass, for example.

Figure 9:
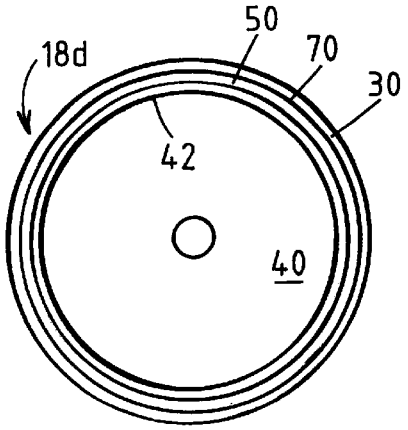
FIG. 9 illustrates a fourth embodiment of a printing roller usable with the flexographic printing apparatus of FIG. 1.

FIG. 9 illustrates a fourth embodiment of a printing roller 18*d* that may be used in the printing apparatus 10. The printing roller 18*d* is generally the same as the printing roller 18*b* described above in connection with FIG. 7, except that a conductive layer 70 is disposed between the printing plate 30 and the insulating layer 50. The conductive layer 70 could be provided, for example, in the form of a thin, metal layer plated onto or otherwise provided on the outer surface of the insulating layer 50 or the inner surface of the printing plate 30.

Figure 5:
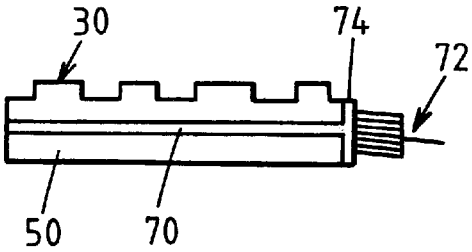
FIG. 5 illustrates a brush that is applying an electric charge to a portion of the printing roller.

The purpose of the conductive layer 70 is to allow an electric charge to be applied to the printing roller 18, via direct physical contact, so that a lower voltage can be used to apply the charge. FIG. 5 illustrates one manner in which an electric charge could be directly applied to a portion of the printing roller 18*d*. Referring to FIG. 5, the electric charge could be applied via a conductive brush 72 that makes contact with a conductive surface 74 integrally formed or otherwise conductively connected to the conductive layer 70. Since direct contact is made, the conductive brush 72 could be connected to a voltage source providing a voltage in the range of one thousand to three thousand volts, for example, instead of the higher voltage necessary for the charge bar 26.

Figure 10:
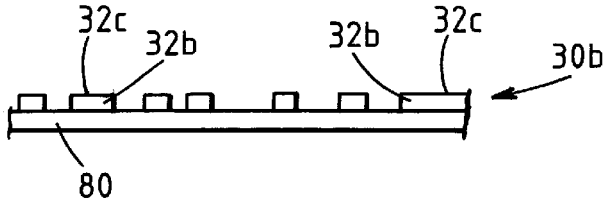
FIG. 10 is a side view of a portion of an alternative embodiment of a printing plate used in the flexographic printing apparatus.

FIG. 10 illustrates an alternative embodiment of a printing plate 30*b* that could be used in each of the embodiments of FIGS. 6–9. Referring to FIG. 10, the printing plate 30*b* has a substrate layer 80 and a printing layer composed of raised portions 32*b*, with each raised portion 32*b* having a raised surface 32*c*. Together, the raised surfaces 32*c* of the raised portions 32*b* make up the desired image-forming surface. The raised portions 32*b* may be composed of photo-sensitive material. The substrate layer 80 may comprise an insulating layer having a resistivity in excess of about two megohms per cubic centimeter.

The printing plate 30*b* of FIG. 10 may be manufactured by depositing or otherwise forming a layer of semi-conductive, photo-sensitive polymer material on top of an insulating substrate. The semi-conductive material may then be photo-etched, as described above, until all semi-conductive material except for the raised portions 32 is removed.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A flexographic printing apparatus for printing a moving web, said printing apparatus comprising:

a rotatable ink roller;

a roller support that rotatably supports said ink roller;

an ink source associated with said ink roller, said ink source providing ink to be applied to said ink roller;

a rotatable printing roller associated with said ink roller;

a printing plate disposed on said printing roller, said printing plate being supported so that ink is transferred from said ink roller to said printing plate as said ink roller and said printing roller rotate, said printing plate comprising:

a semi-conductive printing layer having an image-forming surface, said semi-conductive printing layer comprising a photo-sensitive polymer material; and a substrate layer on which said semi-conductive printing layer is formed, said substrate layer comprising an insulating material having a resistivity of greater than about two megohms per cubic centimeter, said semi-conductive printing layer comprising a plurality of portions of semi-conductive material formed on said substrate layer, said portions of said semi-conductive material being spaced apart and formed so that portions of said substrate layer are not covered by said portions of said semi-conductive material;

an insulating layer disposed on said printing roller, said insulating layer being disposed between an outer surface of said printing roller and said printing plate;

a rotatable backing roller disposed adjacent said printing roller so that said moving web to which ink is to be applied passes between said backing roller and said printing plate as said backing roller and said printing roller rotate so that a printed image is applied to said web; and a charge applicator associated with said printing roller, said charge applicator causing an electric charge to be applied to said printing plate, said charge applicator comprising an elongate charge bar having a plurality of charging electrodes spaced from said printing plate, said charging electrodes being evenly spaced from each other in a direction parallel to a central axis of said printing roller, each of said charging electrodes being conductively connected to a voltage.

2. An apparatus as defined in claim 1 wherein said semi-conductive printing layer has a resistivity in the range between about 100 thousand ohms per cubic centimeter and about one megohm per cubic centimeter.

3. A flexographic printing apparatus for printing a moving web, said printing apparatus comprising:

a rotatable ink roller;

a roller support that rotatably supports said ink roller;

an ink source associated with said ink roller, said ink source providing ink to be applied to said ink roller;

a rotatable printing roller associated with said ink roller;

a printing plate disposed on said printing roller, said printing plate being supported so that ink is transferred from said ink roller to said printing plate as said ink roller and said printing roller rotate, said printing plate comprising:

a semi-conductive printing layer having an image-forming surface, said semi-conductive printing layer comprising a photo-sensitive polymer material; and a substrate layer on which said semi-conductive printing layer is formed, said substrate layer comprising an insulating material having a resistivity of greater than about two megohms per cubic centimeter, said semi-conductive printing layer comprising a plurality of portions of semi-conductive material formed on said substrate layer, said portions of said semi-conductive material being spaced apart and formed so that portions of said substrate layer are not covered by said portions of said semi-conductive material;

an insulating layer disposed on said printing roller, said insulating layer being disposed between an outer surface of said printing roller and said printing plate;

a rotatable backing roller disposed adjacent said printing roller so that said moving web to which ink is to be applied passes between said backing roller and said printing plate as said backing roller and said printing roller rotate so that a printed image is applied to said web; and a direct-contact charge applicator that makes physical contact with said conductive layer, said direct-contact charge applicator being conductively connected to a voltage.

4. An apparatus as defined in claim 3 wherein said semi-conductive printing layer has a resistivity in the range between about 100 thousand ohms per cubic centimeter and about one megohm per cubic centimeter.

* * * * *